US007500425B2

(12) United States Patent
Seipel et al.

(10) Patent No.: US 7,500,425 B2
(45) Date of Patent: Mar. 10, 2009

(54) AXIAL PISTON MACHINE

(75) Inventors: Volker Seipel, Bickenbach (DE); Willi Parsch, Seeheim (DE); Georg Weber, Egelsbach (DE); Peter Barth, Bielefeld (DE); Henry Wittkopf, Jena (DE); Peter Kuhn, Weinheim (DE)

(73) Assignee: Luk Fahrzeug-Hydraulik GmbH & Co. KG, Bad Homburg v.d.H. (DE)

( * ) Notice: Subject to any disclaimer, the term of this patent is extended or adjusted under 35 U.S.C. 154(b) by 0 days.

(21) Appl. No.: 10/538,719

(22) PCT Filed: Dec. 12, 2003

(86) PCT No.: PCT/EP03/14150

§ 371 (c)(1),
(2), (4) Date: Mar. 9, 2006

(87) PCT Pub. No.: WO2004/055370

PCT Pub. Date: Jul. 1, 2004

(65) Prior Publication Data

US 2006/0230922 A1 Oct. 19, 2006

(30) Foreign Application Priority Data

Dec. 13, 2002 (DE) ..... 102 58 311

(51) Int. Cl.
*F04B 27/10* (2006.01)
*F04B 39/02* (2006.01)

(52) U.S. Cl. ..... 92/110; 92/158; 92/260

(58) Field of Classification Search ..... 92/71, 92/109, 110, 154, 158, 255, 260
See application file for complete search history.

(56) References Cited

U.S. PATENT DOCUMENTS

| | | | | |
|---|---|---|---|---|
| 4,379,425 | A * | 4/1983 | Ishizuka | 92/71 |
| 5,851,320 | A | 12/1998 | Auran et al. | 148/552 |
| 5,943,941 | A * | 8/1999 | Kato et al. | 92/71 |
| 6,038,960 | A * | 3/2000 | Fukushima et al. | 92/71 |
| 6,321,635 | B1 * | 11/2001 | Fujita | 92/71 |
| 6,357,340 | B1 * | 3/2002 | Kato et al. | 92/155 |
| 6,415,705 | B1 * | 7/2002 | Kato et al. | 92/71 |
| 6,513,417 | B1 * | 2/2003 | Sugiura et al. | 92/71 |
| 6,530,149 | B2 * | 3/2003 | Sugiura et al. | 29/888.042 |
| 6,604,284 | B1 * | 8/2003 | Kato et al. | 29/888.042 |
| 6,739,236 | B2 * | 5/2004 | Kato et al. | 92/71 |
| 2001/0022134 | A1 * | 9/2001 | Sugiura et al. | 92/172 |

FOREIGN PATENT DOCUMENTS

| | | |
|---|---|---|
| DE | 199 44 476 A1 | 3/2000 |
| JP | 05 044641 A | 2/1993 |

* cited by examiner

*Primary Examiner*—Thomas E Lazo
(74) *Attorney, Agent, or Firm*—Davidson, Davidson & Kappel, LLC

(57) ABSTRACT

The invention relates to an axial piston machine, in particular, an air-conditioning compressor for motor vehicles, with at least one piston, an essentially cylindrical piston shaft and an enclosure, which encloses a tilt ring or a tilt disc and a piston slipper sliding on said tilt ring or said tilt disc, whereby the enclosure has spherical recesses for housing the piston slipper.

19 Claims, 11 Drawing Sheets

"A - A"

AXIAL PISTON MACHINE

The present invention relates to an axial piston machine, in particular, an air-conditioner compressor for motor vehicles, including at least one piston having a substantially cylindrical piston body and a brace that embraces a tilting ring or a tilting plate and piston shoes sliding on said tilting ring or said tilting plate; the brace having spherical cap-shaped depressions for receiving the piston shoes, said depressions being located on the side of the piston body and on the opposite side.

BACKGROUND

Also, the piston braces of known pistons project radially outward relatively far from the piston axis so as to provide sufficient space for the movement of the tilting plate or tilting ring and the piston shoes, while being sufficiently stiff to prevent the piston shoes from falling out.

Moreover, in tilting-ring or tilting-plate type compressors, the lubrication of the radially outward sliding surface of the brace between the piston and the housing is of great importance, especially if, when using $CO_2$ as the refrigerant, the machine dimensions are smaller than in conventional refrigerant compressors because of the high pressures. As a consequence of the tight spaces in a $CO_2$ compressor, the spaces between the pistons where lubricant can be distributed, for example, in the drive chamber, become narrower and narrower. The larger the peripheral housing region covered by the piston brace is compared to the exposed peripheral region of the housing, the more difficult is it to supply lubricant to this region. If in tilting plate machines or tilting ring machines of this type, such as for $CO_2$ applications, the degree of coverage by the piston brace becomes relatively high so that there are only small gaps between the individual piston brace regions for introducing lubricant between the peripheral regions, insufficient lubricant supply and friction damage may occur in this area.

SUMMARY OF THE INVENTION

It is an object of the present invention to devise an axial piston machine which will overcome some or all of these disadvantages.

It is a feature of an axial piston machine according to the present invention that the cylindrical piston body and the brace are two separate parts from which the piston can be assembled. The advantage of this is that the materials and manufacturing methods for these differently shaped parts can be adapted to the different loads.

Also preferred is an axial piston machine whose brace can be made from a strip of sheet metal and, after suitably shaping the metal strip, is connectable to the cylindrical piston body, which can be made as a deep-drawn part of sheet metal. Another preferred axial piston machine is one in which the opening in the brace can be made by punching. Also, the seating of the piston shoes can be produced or largely preformed during the forming process of the brace. Also preferred is an axial piston machine in which the cylindrical piston body and the brace can be made from a steel material. A further preferred axial piston machine is one in which the brace and the cylindrical piston body can be joined together by laser welding or resistance welding. Moreover, the hollow space between the brace and the piston body can be airtight, or nearly airtight.

Another embodiment of the axial piston machine according to the present invention is characterized in that, after the brace and the piston body are assembled together, the piston is first provided with an adhesive base coat, for example by phosphating, in a layer thickness of about 2-3 μm, and then provided with a surface coating of PTFE in a layer thickness of about 10 μm.

An axial piston machine according to the present invention is characterized in that a first spherical recess is disposed within the bridge of the brace, that is, in the inner radial region of the piston brace.

Moreover, the spherical running surfaces of the piston shoes in the brace can seamlessly merge into the first spherical recess in the bridge of the brace, and the spherical running surfaces and the first spherical recess can preferably have equal sphere radii. Also preferred is a first spherical recess which can be processed by and during the machining of the piston shoe bearing surfaces, or fully produced by this machining process. Preferably, the bridge of the brace is adapted, on its inner side, to the contour of the tilting ring or tilting plate by a second spherical recess of larger radius outside the first spherical recess. In accordance with the present invention, the second spherical recess allows the bridge of the brace to be shifted as close as possible to the tilting ring or tilting plate. This reduces the bending load on the brace by shorter lever arms. The first spherical recess only slightly reduces the stiffness of the brace, because the first spherical recess is located very close to the bending line. This is made possible because the second spherical recess shifts the bending line of the brace so close to the tilting plate or tilting ring that the stiffness against bending during the suction movement is only slightly reduced compared to a brace without a first spherical recess. Because of this, less material and installation space are needed, which reduces costs.

The present invention furthermore provides an axial piston machine in which the outer side, as a sliding surface, of the brace has at least one opening to the inner radial region of the brace which faces the tilting plate or tilting ring. Preferably, the at least one opening serves to supply lubricant to the sliding surface, because the sliding surface is located in the peripheral region covered by the piston brace and, therefore, can only with difficulty be supplied with the lubricant contained in the refrigerant in the drive mechanism housing.

In a further embodiment of the axial piston machine according to the present invention, the peripheral region of the piston brace which is designed as a sliding surface has several and/or differently shaped openings or opening regions.

A preferred axial piston machine is one in which the peripheral region of the piston brace which is designed as a sliding surface has formed therein pocket-shaped regions opposite the drive mechanism housing wall which serves as a running surface, said pocket-shaped regions being supplied via at least one lubrication opening.

The above-mentioned embodiments allow the peripheral region covered by the piston brace to be supplied with lubricant that is spun off of the rotating tilting plate or tilting ring by centrifugal forces and thus enters the space between the piston and the housing wall through the openings.

BRIEF DESCRIPTION OF THE DRAWINGS

The present invention will now be described with reference to the figures, in which.

DETAILED DESCRIPTION

Figure 1:
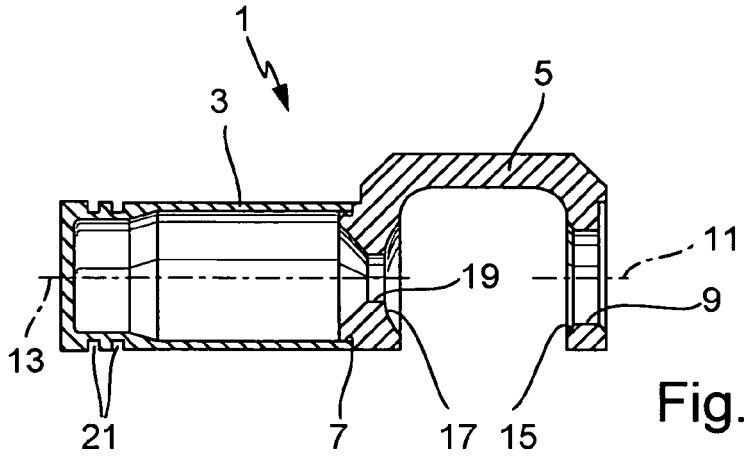
FIG. 1 is a cross-sectional view of a two-part piston.

FIG. 1 is a cross-sectional view of a two-part piston 1, which is composed of a cylindrical piston body 3 and a U-shaped piston brace 5. The two parts are joined together in region 7 by laser welding. However, other joining techniques, such as resistance welding, brazing, adhesive bonding, press-fitting, crimping, or form-locking connections, such as circlips, threads, etc., are possible as well. Cylindrical piston body 3 can preferably be made from thin sheet steel using a deep drawing process. The use of steel sheet has the advantage that the piston body can have a thin-walled design in spite of high pressure loads, and that it can advantageously be produced in large quantities by deep drawing. However, the blanks of the parts can also be produced by cold extrusion, hot extrusion, or forging. In some cases, it can be advantageous to manufacture such a piston from aluminum materials. Piston brace 5 can be made from a strip of sheet steel, which is then suitably shaped from a flat metal strip into the U-shaped piston brace in a stamping tool. The use of a two-piece design has the advantage that the two component parts of different basic shapes can be manufactured separately according to their shapes instead of having to be formed from a single piece in a much more complicated way. Thus, piston brace 5 can also be advantageously made from a steel material, which provides significantly greater resistance to the forces occurring during operation. Piston brace 5 has a cylindrical opening 9 at its side opposite the piston body 3; center axis 11 of said cylindrical opening coinciding with center axis 13 of cylindrical piston body 3. On the inner side of the piston brace 5, opening 9 leads into a spherical cap-shaped region 15, which serves to receive a spherical cap-shaped piston shoe (not shown here). Likewise, at the side of brace 5 next to cylindrical piston shaft 3, a spherical cap-shaped region 17 which is capable of receiving a second piston shoe is provided within the brace; the two piston shoes sliding on a tilting plate or tilting ring located therebetween. The portion of brace 5 next to piston body 3 is provided with a smaller opening 19 which provides a connection to the interior of piston body 3. Piston body 3 is provided at its front end with two grooves 21 which serve to receive piston sealing rings.

Figure 2:
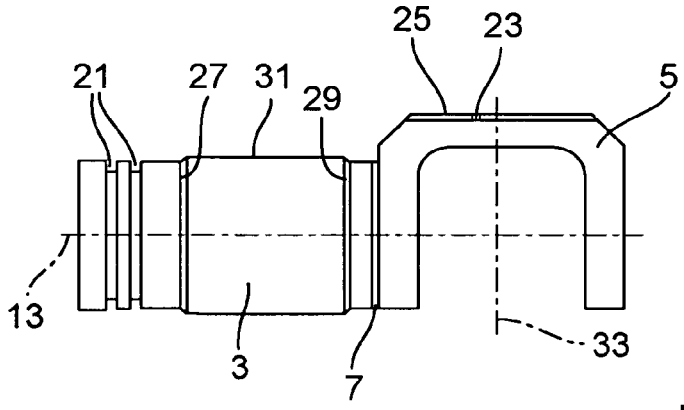
FIG. 2 shows the same piston in a side view.

In FIG. 2, piston 1 of FIG. 1 is shown in a side view in which it can be seen that piston brace 5 is provided on its upper side with a beveled step 23 leading to a raised region 25 with which piston 1 bears against a corresponding sliding surface of the housing inside the housing. Moreover, piston body 3 has two bevels 29 and 27 leading to a region 31 which has a larger diameter and acts as a guiding cylinder section within a cylinder liner. Within piston brace 5, axis 13 of cylindrical piston body 3 crosses an axis 33, the crossing point defining the center of a spherical shape of the spherical cap-shaped piston shoes and of bearing regions 15 and 17, respectively.

Figure 3:
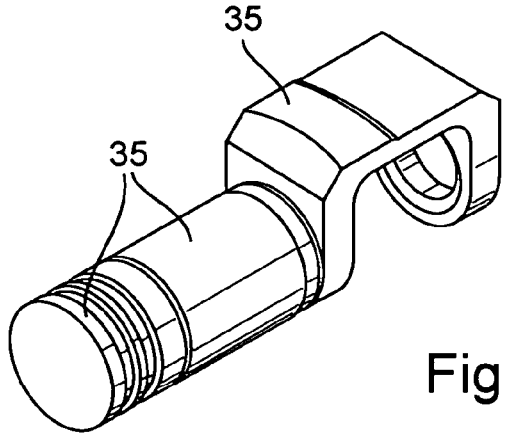
FIG. 3 shows the same piston in a perspective view.

In FIG. 3, piston 1 of FIG. 1 and FIG. 2 is depicted in a perspective view showing regions 35 in which a suitable coating can be applied to the steel components by means of an adhesive base coat, especially by phosphating the entire piston in a layer thickness of about 2-3 μm, and by subsequently providing marked regions 35 with an anti-friction coating of PTFE in a layer thickness of about 10 μm. However, other coatings, such as WC/C coatings, or heat treatments, such as case hardening, are conceivable as well. The two-piece piston design is especially preferred because the different component shapes can be produced using manufacturing processes that are optimally adapted to the shapes. As has been mentioned earlier, deep-drawing of thin sheet steel is a suitable method for cylindrical piston body 3, while initial punching of sheet steel and subsequent bending to shape is convenient for piston brace 5. During the punching process, it is also possible to produce openings 9 and 19 and to preform spherical cap regions 15 and 17 in advance. In some cases, however, it may also be appropriate to select aluminum materials.

Figure 4:
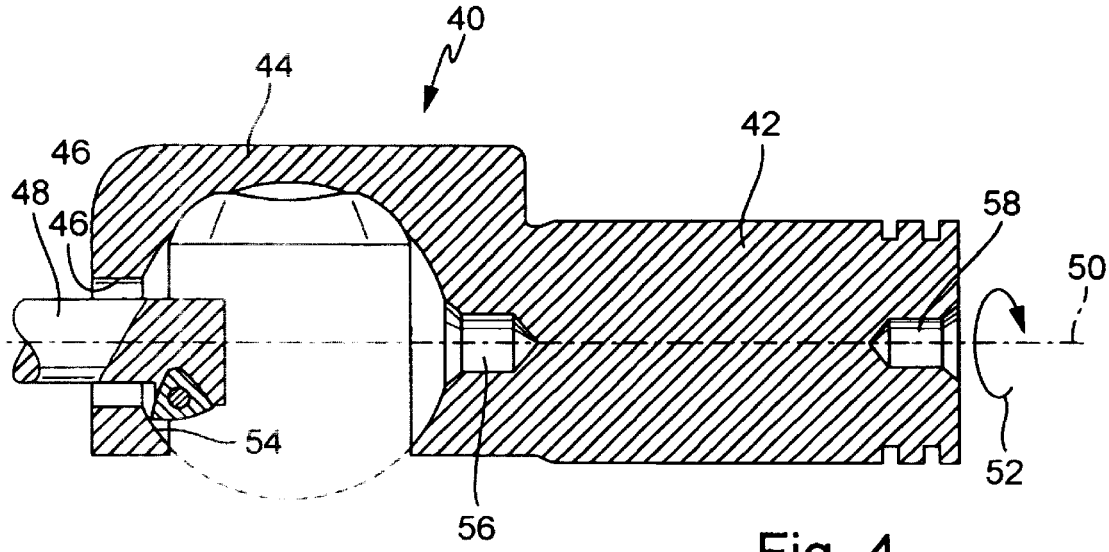
FIG. 4 illustrates the machining of the rear spherical cap.

FIG. 4 is a cross-sectional view of a piston 40. In this representation, piston 40 is shown solid in cross-section and may be manufactured, for example, from an aluminum material. Piston 40 likewise has a cylindrical piston body 42 and a brace 44; the end of brace 44 opposite the piston body 42 being provided with an opening 46 which corresponds to opening 9 of FIG. 1. Opening 46 allows a cutting tool 48 to be inserted into the interior of piston brace 44. Thus, by rotation 52 about piston-cylinder axis 50, which corresponds to cylinder axis 13 in FIG. 1, rear spherical cap 54 can be produced by the machining motion on standard lathes, which is not possible in the case of known forms of braces without such an opening 46. Moreover, in this machining process, a centering center 56 or a weight-reduction hole (not shown) can be made in piston body 42, and a second centering center 58 can be produced on the front face of piston body 42, these openings allowing dimensionally stable chucking during further processing steps on lathes and grinding machines, for example, for turning and grinding a coating.

Figure 5:
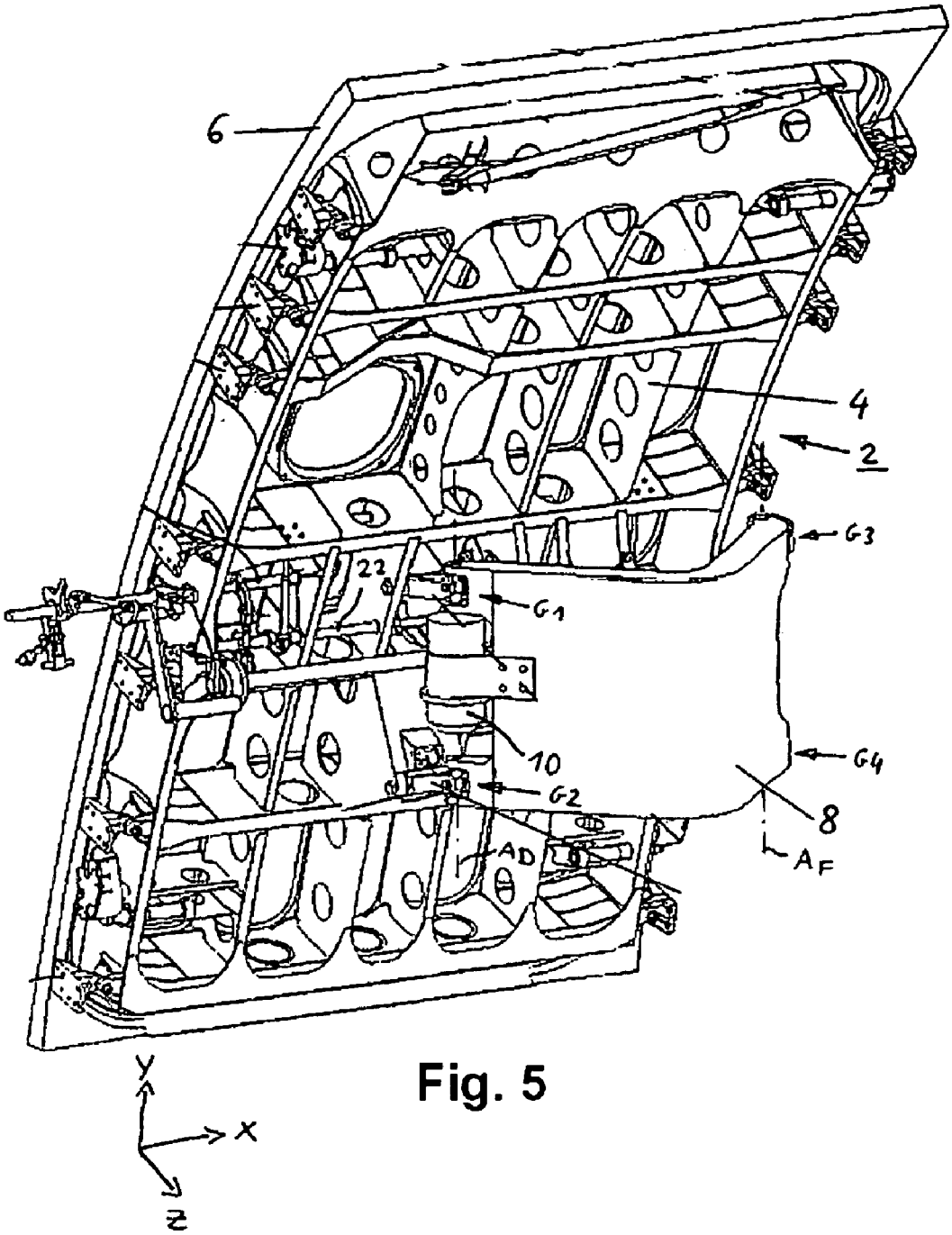
FIG. 5 illustrates the machining of the front spherical cap.

FIG. 5, finally, shows the machining of the front spherical cap shape 62 in brace 44. A cutting tool 60 for machining the front spherical cap shape 62 is also inserted through opening 46 in brace 44, and the spherical cap shape is then produced by suitably moving tool 60 axially and vertically during simultaneous rotation 52 of piston 40 about axis 50. This means that the piston brace has been altered by opening 46 in piston brace 44 in such a manner that the cutting motion for machining the spherical shape can be produced by rotating piston 40 about axis 50 of piston body 42, that is, about the cylinder axis. Therefore, neither special machines nor special devices are needed; the machining is not carried out under interrupted cutting conditions, that is, the cutting tool does not move out of and back into the workpiece during machining and, in addition, it is possible to provide the edges of the spherical shape with lubricating wedge chamfers.

This results in both considerable cost savings and better quality of manufacture and in operational advantages for a machine having such pistons. Of course, the present invention is not limited in its use to air-conditioner compressors, but may also be used in other axial piston machines, such as axial piston pumps, that use diverse tilting-ring or tilting-plate mechanisms including piston shoes. Moreover, the present invention allows the coating of the piston to be processed on lathes and grinding machines in a very stable chucking position. Therefore, this type of chucking is considerably stiffer and more accurate compared to chucking in a centering center on the left side of the brace. As processing variants to the representations in FIGS. 4 and 5, it is also possible to use reversible inserts having a ready-made spherical contour. With these reversible inserts in a tool holder, it is also possible to machine both sides simultaneously.

Figure 6:
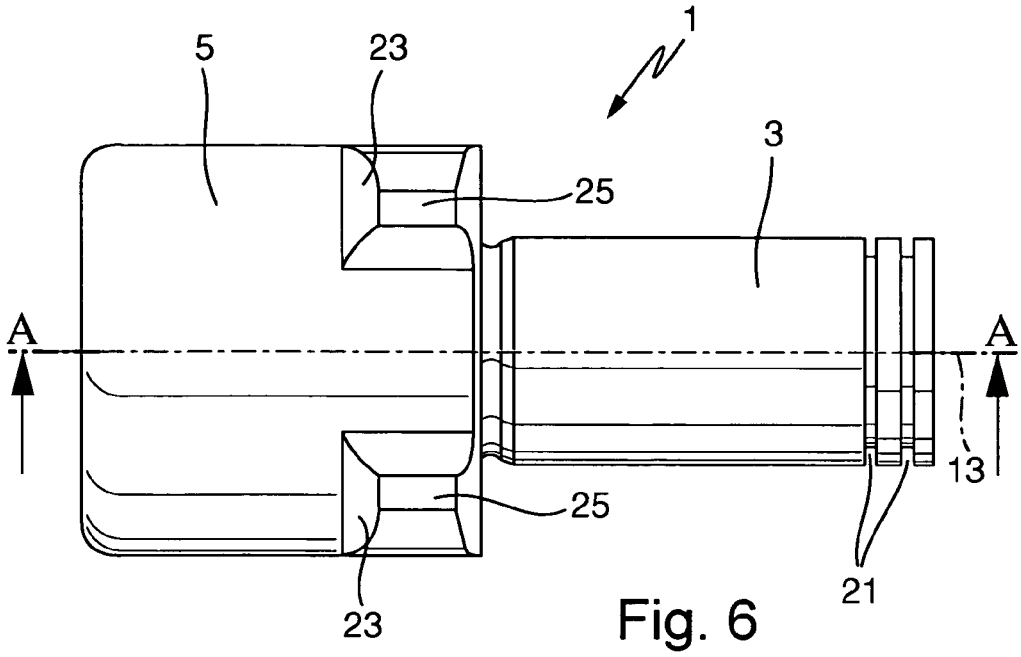
FIG. 6 is a top view of a piston.

FIG. 6 is a top view of a piston 1 according to the present invention. Here, the reference numerals used correspond to those in FIGS. 1 and 2 again. In the top view of FIG. 6, it can be seen, in particular, that bevel 23, which is shown in a side view in FIG. 2, leads to a raised region 25 on piston brace 5, said raised region serving as a suitable contact and sliding surface with respect to the compressor housing wall. This sliding surface 25 exists both on the right and on the left side, that is, here, both at the top and bottom of FIG. 6, and serves both as a sliding surface and to prevent the piston from rotating or tilting sideways.

Figure 7:
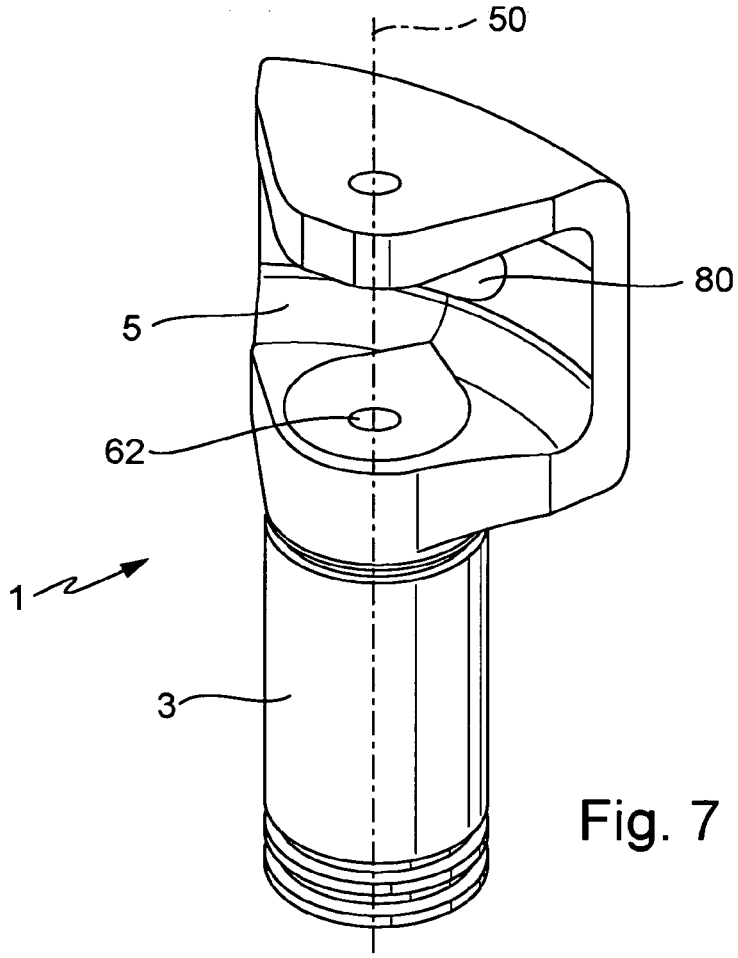
FIG. 7 shows a piston with a first spherical recess.

FIG. 7 is a perspective view of a piston 1 having a brace 5 and a first spherical recess 80 in the of brace 5. The components described hereinbefore are provided with the same reference numerals as, for example, in FIG. 1, and will not be described again in order to avoid repetitions. Additionally shown here is first spherical recess 80, which can be produced simultaneously with the bearing surfaces 62 and, not visible here, 54 for the piston shoes during machining by rotation about cylinder axis 50.

Figure 8:
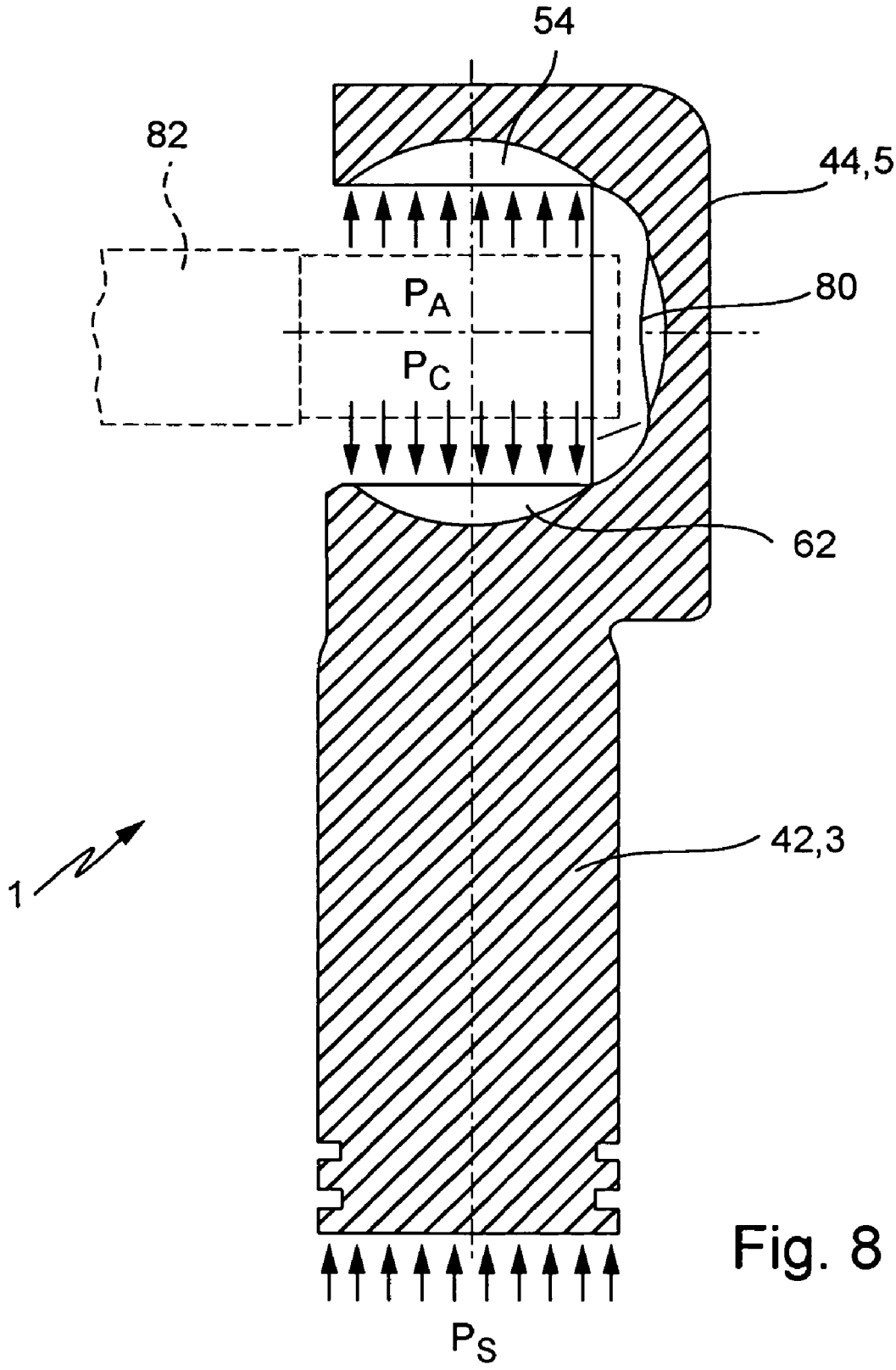
FIG. 8 illustrates the pressures determining the axial forces on the piston.

FIG. 8 shows the pressures and forces acting on piston 1 and piston brace 44, 5 during the suction stroke. During the suction stroke of the piston, tilting ring 82 or the tilting plate pulls piston 1 out of the cylinder block by means of the piston shoes (not shown here). In this process, the movement of tilting ring 82 results in forces PA acting within piston brace 44, 5, said forces PA being transferred to brace 44 or 5 by tilting ring 82 and the piston shoe and tending to bend the brace 44, 5 open. In addition, inside the drive chamber, drive chamber pressure PC acts on the piston cylinder surface in region 62 of piston brace 44, 5, said drive chamber pressure acting against suction pressure PS on the front face of cylindrical piston body 42 or 3, respectively. Thus, during operation, brace 44 or 5 of piston 1 is primarily loaded by bending during the suction movement. In order to achieve maximum possible stiffness during this bending, the back of the brace is shifted radially inward as close as possible to tilting ring 82 or to the tilting plate, respectively; so that, in comparison with a brace that projects radially further outward, recess 80 is located so close to the bending line of the brace that the stiffness against bending during the suction movement is only slightly reduced compared to a brace that does not have a spherical recess 80 and which is located radially further outward and therefore has longer lever arms for bending. To this end, the back of brace 44 or 5, respectively, is adapted, on its inner side, to the cylindrical contour of the tilting ring or tilting plate and their moving positions by a second spherical recess 81, which can be seen in FIG. 9. This results in a space-saving geometry, thus reducing the cost of the compressor.

In FIG. 9, spherical recesses 80 and 81 in the piston brace are shown in four views. FIG. 9*a* is a view of the inner side of the brace 44 or 5, respectively, showing the first spherical cap-shaped depression, that is, spherical recess 80, in the bridge of brace 44, 5 and a second spherical contour 81, which can occupy the entire inner side of the brace. FIG. 9*b* shows section B-B of FIG. 9*a*. Front bearing surface 62 for the front piston shoe can be seen within the cut brace 44 or 5. In cut region 88 of the piston brace, both the raised sliding regions 25 of FIG. 6, which serve as a contact surface with housing contour 86, and first spherical recess 80 can be seen. It can also be clearly seen that second spherical recess 81 provides sufficient clearance from tilting ring contour 84 and the envelope generated by its pivotal movement, and that section B-B follows the contour of tilting ring 84 and housing 86.

Figure 9A:
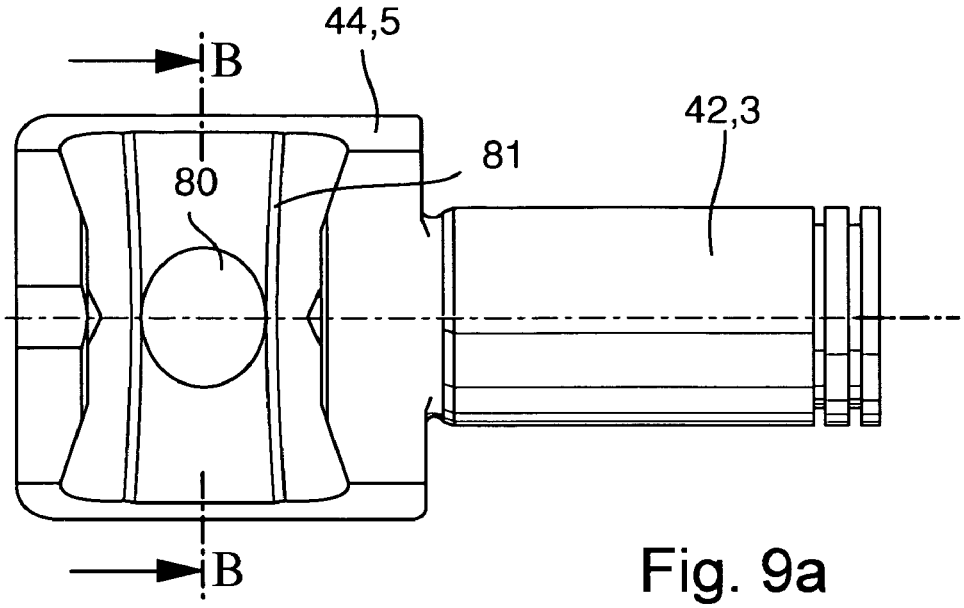
FIG. 9 shows four representations of the first and second spherical recesses.
Figure 9B:
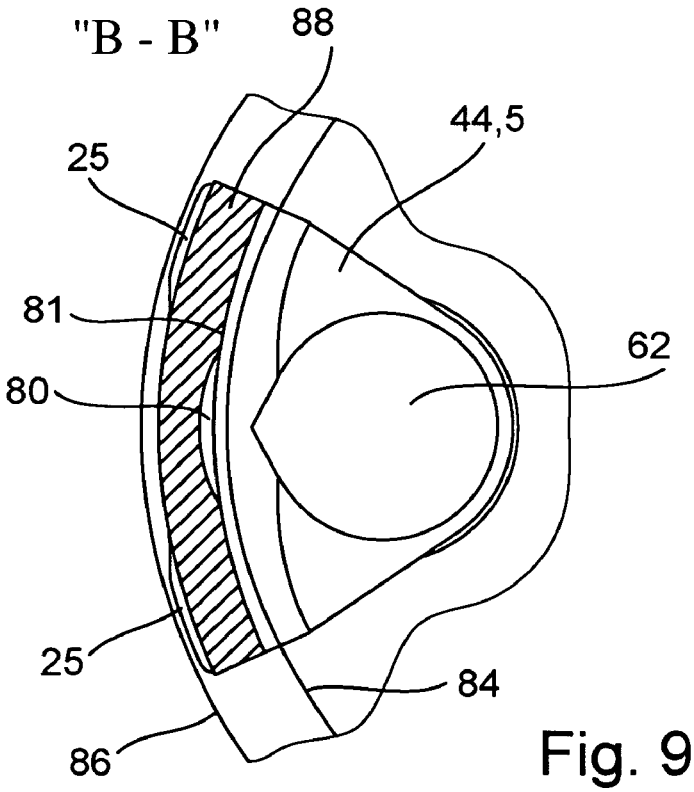
Figure 9C:
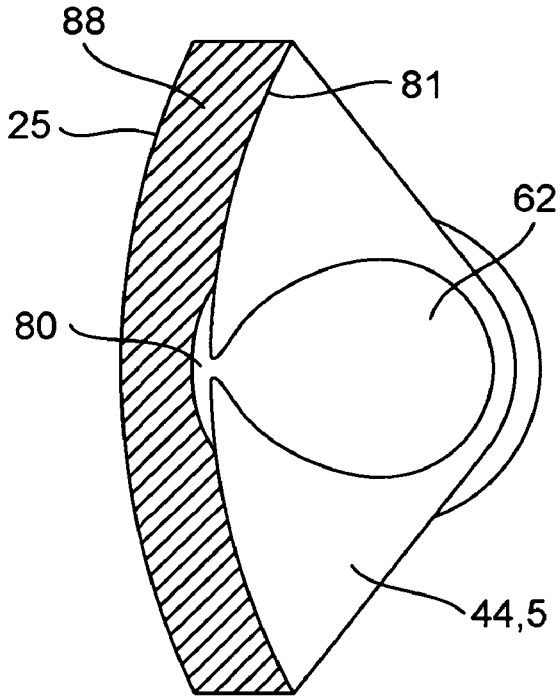

FIG. 9*c* shows that bearing surface 62 and/or opposite bearing surface 54 can seamlessly merge into first spherical recess 80 and form a spherical shape. Similarly to FIG. 9*b*, the section shows second spherical recess 81, which is of considerably larger diameter than first spherical recess 80, and thus is adapted to the radius of the envelope of the tilting plate or of tilting ring 84 of FIG. 9*b*.

Figure 9D:
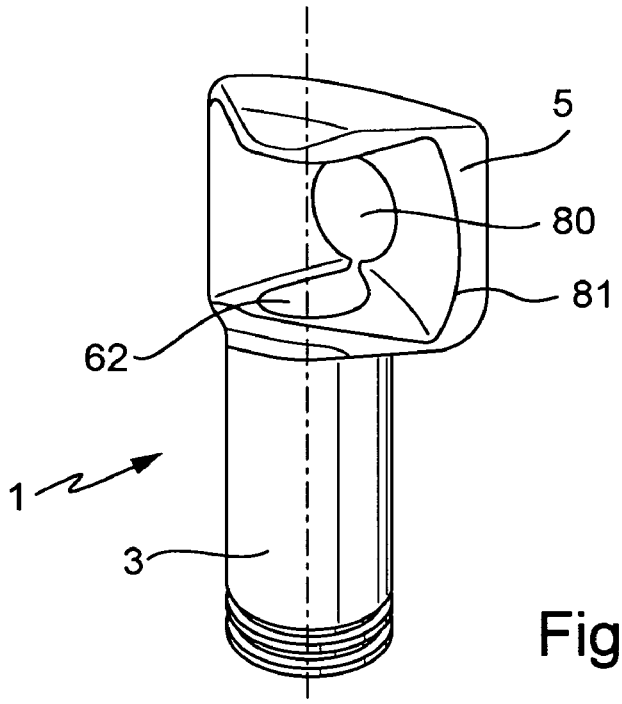

In FIG. 9*d*, spherical recess 81 of the inner surface of the brace can be seen particularly well from the side because of the perspective view. It also becomes clear that by producing bearing surface 62 for the piston shoe, the first spherical recess is simultaneously produced as well.

Figure 10:
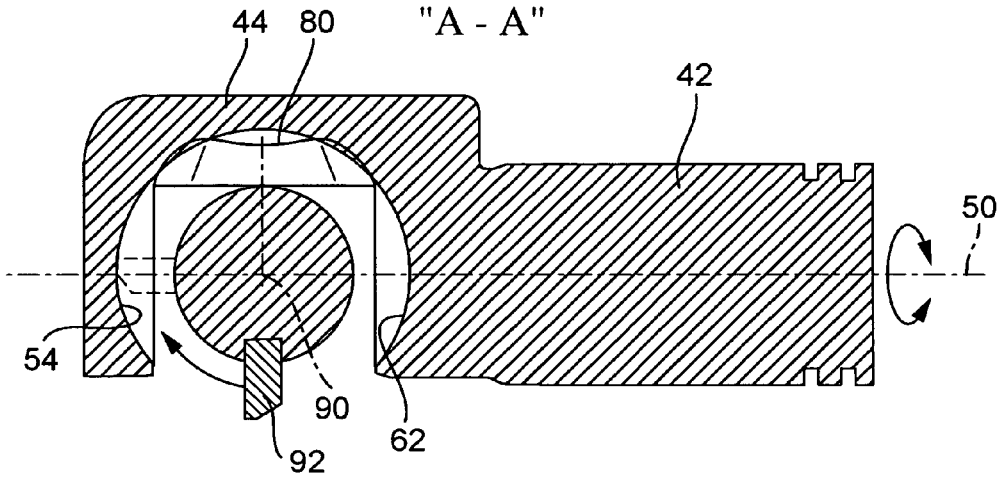
FIG. 10 illustrates the production of the first spherical recess.
Figure 10:
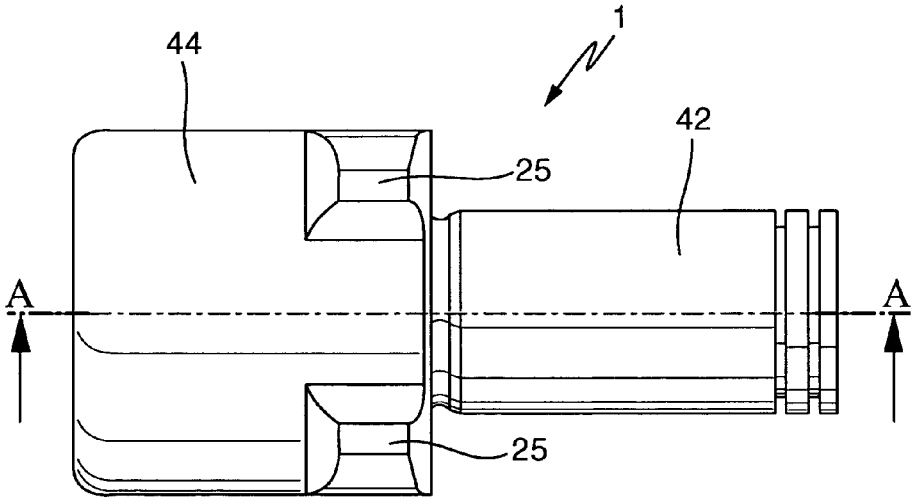

FIG. 10 illustrates the production of first spherical recess 80 together with the production of piston shoe bearing surfaces 62 and 54. While a tool is rotated about an axis of rotation 90 within brace 44, the piston is rotated about its cylinder axis 50 to produce the spherical shape in the brace; the cutting edge of tool 92 producing the contours of bearing surfaces 62 and 54 for the piston shoes as well as spherical recess 80. Thus, by, as it were, shifting the brace 44, 5 closer to the outer contour of the tilting plate or tilting ring, spherical recess 80 is formed in the portion of brace 44 parallel to the cylinder axis during the machining of the spherical shape in brace 44 when using a rotation of piston 1 about its cylinder axis 50. This allows a cost-effective manufacturing process to be combined with a cost- and space-saving geometry of brace 44.

Spherical recess 80 is also formed when rotating the piston about an axis extending perpendicular between tool rotation axis 90 and cylinder axis 50 and running through their intersection point (center of the sphere), while a non-rotating tool cuts the spherical or nearly spherical contour.

Figure 11:
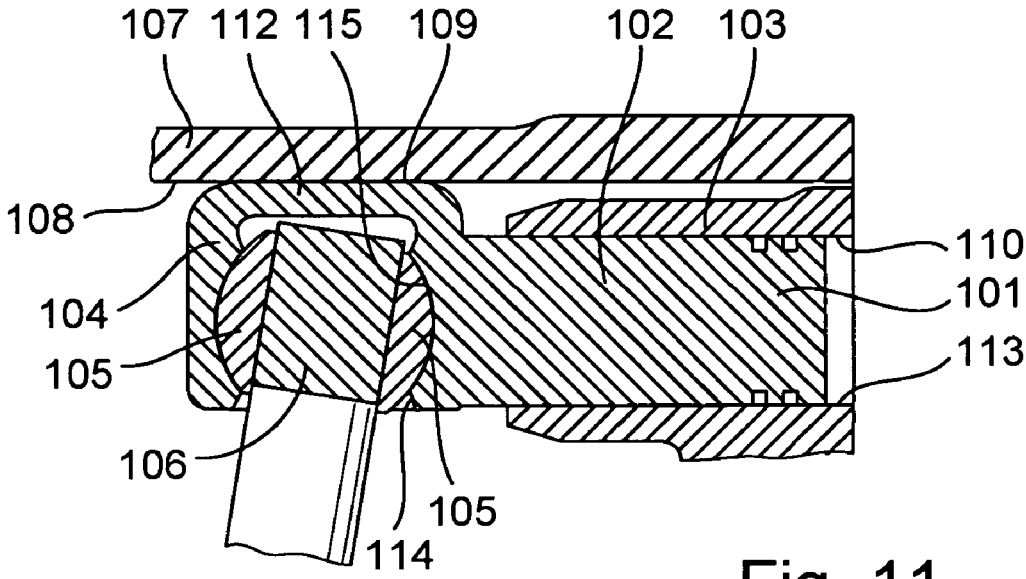
FIG. 11 shows a piston in a portion of a tilting ring machine.

FIG. 11 shows a piston 101 having a cylindrical part 102 which is capable of reciprocating in the opening of a cylinder block 103 and whose cylindrical outer surface therefore forms the first sliding surface with respect to cylinder block bore 113. Piston 101 merges into a second part 104, which serves as brace for tilting plate 106 and piston shoes 105. When tilting plate 106 rotates, piston 101 is caused to reciprocate by means of piston shoes 105, during which tilting plate 106 slides between the flat sides of piston shoes 105, while the piston shoes 105 themselves perform a kind of a wobbling motion within the piston brace. Piston brace 104, in turn, slides in drive mechanism housing 107, which is only partially shown, along inner wall 108, thus forming a second sliding surface 109.

Figure 12:
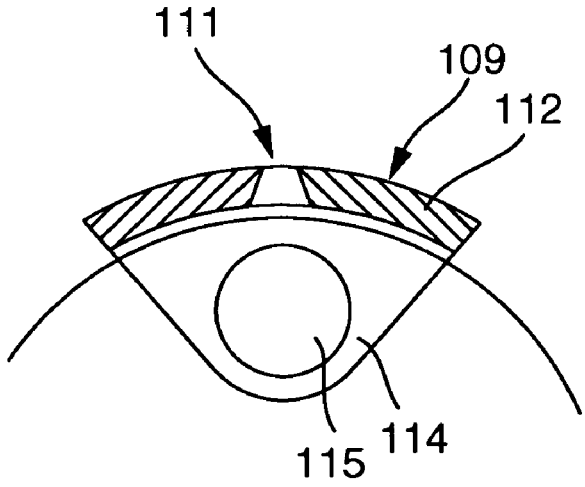
FIG. 12 is a cross-sectional view through a piston brace.
Figure 13:
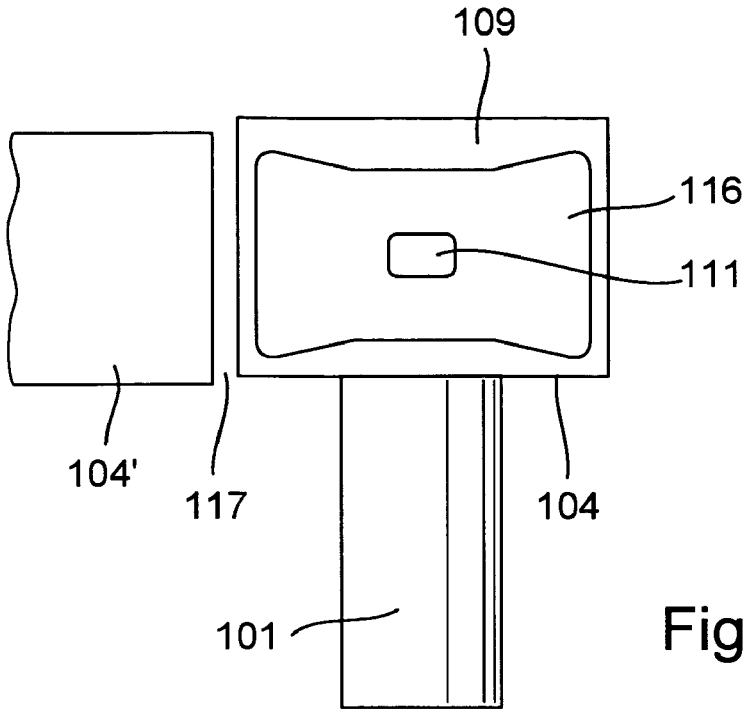
FIG. 13 is a top view of a piston.

FIG. 12 is a cross-sectional view through the piston brace, such as is described in the present invention and shown in a top view in FIG. 13. In FIG. 13, second sliding surface 109 is pierced by an opening 111 via which lubricant from the interior, especially that thrown off of rotating tilting plate 106 (FIG. 11) by centrifugal forces, is conveyed through the piston brace to the upper side, that is, to sliding surface 109. A sliding surface 115 for the front piston shoe can be seen on piston brace front surface 114 below the cut piston brace surface 112; a piston shoe 105 of FIG. 11 performing a wobbling motion in said sliding surface. Opening 111 can be frustoconical in shape so as to catch the lubricant over a wider area.

FIG. 13 is a top view of a piston according to the present invention. Cylindrical piston part 101, the diameter of which is smaller than that of the curvature of brace surface 109, is adjoined by the second portion, piston brace 104. Located in brace part 104 is the opening 111 provided for lubricant supply, which here is, for example, oval in cross-section, and is surrounded by a pocket-shaped recess 116 for receiving the lubricant. This pocket-shaped opening 116 is shown in cross-section in FIG. 16. Also indicated in FIG. 13 is an adjacent piston brace 104', which shows that, in a machine according to the present invention, there is only a very small gap 117 left between the piston braces, which may not be sufficient for lubricant supply to brace sliding surfaces 109.

Figure 14:
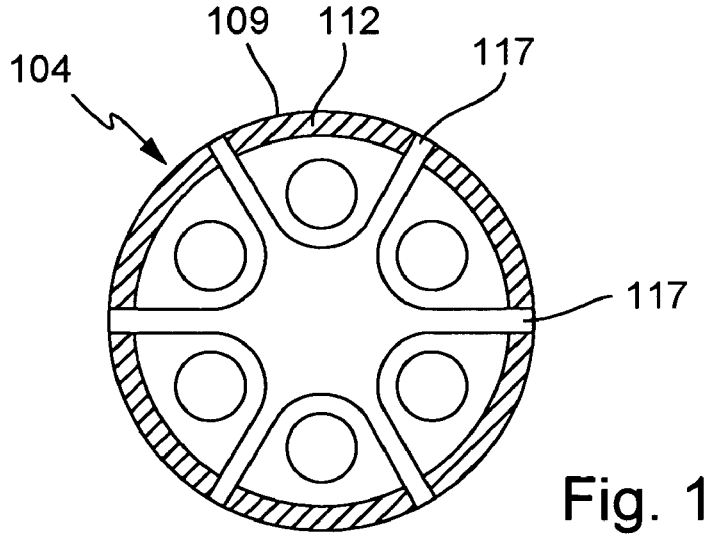
FIG. 14 shows the piston arrangement in the drive mechanism chamber.

FIG. 14 shows, by way of example, six piston braces in cross-section in one machine. It can be seen that there are only very narrow gaps 117 between the six piston braces 104 with their sliding surfaces 109. This means that lubricant that is spun off of a rotating slant or tilting plate within the drive chamber may possibly not be able to make its way from gaps 117 to the center of sliding surfaces 109.

Figure 15:
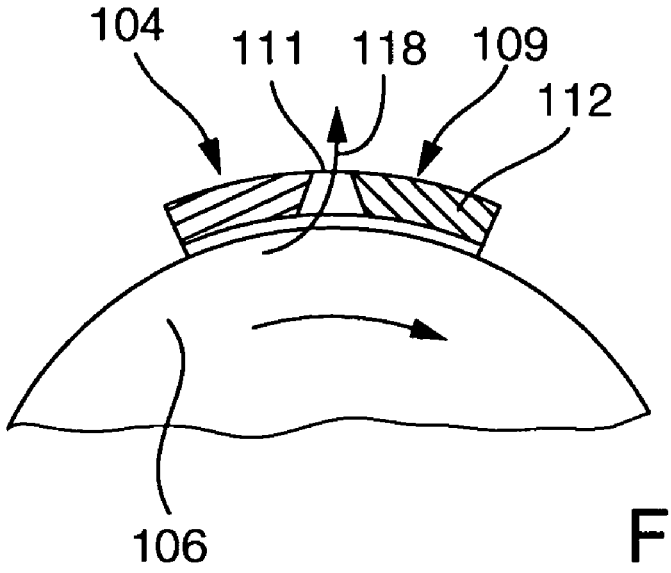
FIG. 15 shows a rotating tilting plate with a piston according to the present invention.

Therefore, in accordance with the present invention, and as shown in FIG. 15, lubricant supply is provided through opening 111 in that lubricant 118 is passed, under the action of the centrifugal forces, from the rotating slant or tilting plate or tilting ring 106 through the opening to surface 109, where it can lubricate second sliding surface 109 between the drive chamber housing wall and the radial outer surface of piston brace 104.

Figure 16:
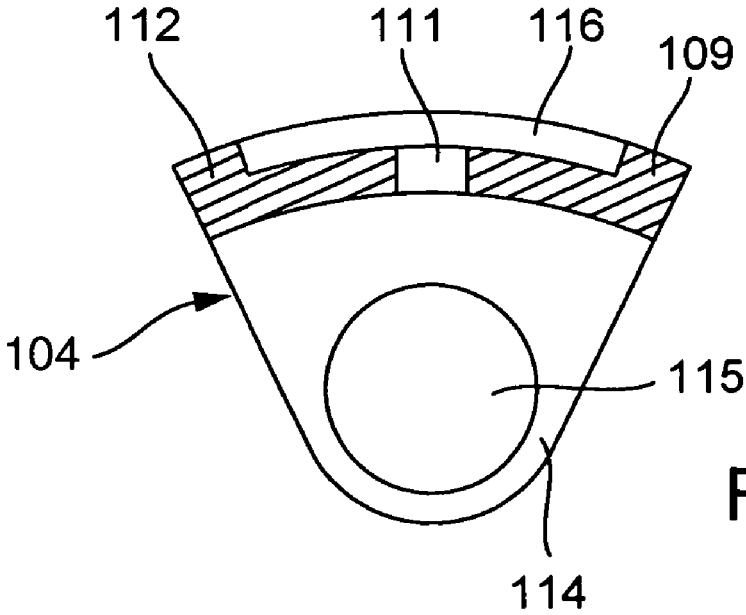
FIG. 16 shows a piston having a lubricant pocket.

FIG. 16 also shows a cross-section of a piston brace 104 according to the present invention; the surface 109 of said piston brace being provided with a lubricant pocket 116 in addition to lubricant opening 111; it being possible for the lubricant pocket to be made in different shapes, as required. The purpose of this lubricant pocket is to collect the lubricant that has passed through opening 111 above the piston brace, and to supply it to sliding surface 109 in sufficient quantities.

What is claimed is:

1. An axial piston machine comprising:

at least one piston having a substantially cylindrical piston body, and a brace configured to receive at least one of a tilting ring and a tilting plate and piston shoes slidably disposed on the at least one of the tilting ring and the tilting plate, wherein the brace includes spherical cap-shaped depressions for receiving the piston shoes, the depressions being located on a first side of the brace adjacent the piston body and on a second side of the piston brace opposite the first side, wherein the substantially cylindrical piston body and the brace are separate parts assembled together to form the piston, wherein the piston brace includes a bridge connecting the first and second sides of the bridge and a first spherical recess disposed within the bridge.

2. The axial piston machine as recited in claim 1, wherein the brace has an opening on the second side of the piston brace, opposite the piston body.

3. An axial piston machine as recited in claim 1, wherein the axial piston machine includes an air-conditioner compressor for a motor vehicle.

4. The axial piston machine as recited in claim 1, wherein the brace includes a strip of sheet metal, and the piston body includes a deep-drawn part of sheet metal, the brace being connectable to the cylindrical piston body.

5. The axial piston machine as recited in claim 1, wherein the brace includes a punched opening.

6. The axial piston machine as recited in claim 1, wherein the spherical cap-shaped depressions are produced during a forming process of the brace.

7. The axial piston machine as recited in claim 1, wherein the brace and the piston body are formed from a steel material.

8. The axial piston machine as recited in claim 1, wherein the brace and the piston body are joined together by at least one of laser welding and resistance welding.

9. The axial piston machine as recited in claim 1, wherein the piston includes a substantially air tight hollow space between the brace and the piston body.

10. The axial piston machine as recited in claim 1, wherein the assembled piston includes a coating, wherein the coating includes a phosphate coat applied as an adhesive base in a layer thickness of about 2-3 μm, and a PTFE coat applied as a second layer in a layer thickness of about 10 μm.

11. The axial piston machine as recited in claim 1, wherein the piston shoes includes spherical running surfaces that merge into the first spherical recess.

12. The axial piston machine as recited in claim 11, wherein a first radius of the first spherical recess is equal to a running surface radius of the spherical running surfaces.

13. The axial piston machine as recited in claim 1, wherein the bridge includes a second spherical recess on an inner side having a larger radius than the first spherical recess, the second spherical recess being adapted to a contour of the at least one of the tilting ring and the tilting plate.

14. The axial piston machine as recited in claim 13, wherein the second spherical recess enables the bridge to shift toward the at least one of the tilting ring and the tilting plate, respectively.

15. The axial piston machine as recited in claim 13, wherein due to the second spherical recess, a bending line of the brace is so close to the at least one of the tilting plate and the tilting ring, respectively, that a stiffness against bending during a suction movement is only slightly reduced compared to a brace without a first spherical recess.

16. An axial piston machine comprising:

at least one piston having a substantially cylindrical piston body, and a brace configured to receive at least one of a tilting ring and a tilting plate and piston shoes slidably disposed on the at least one of the tilting ring and the tilting plate, wherein the brace includes spherical cap-shaped depressions for receiving the piston shoes, the depressions being located on a first side of the brace adjacent the piston body and on a second side of the piston brace opposite the first side, wherein the substantially cylindrical piston body and the brace are separate parts assembled together to form the piston, wherein the brace defines an inner radial region facing the at least one of the tilting plate and the tilting ring and an outer side, and wherein the outer side includes a sliding surface having at least one opening to the inner radial region.

17. The axial piston machine as recited in claim 16, wherein the at least one opening supplies a lubricant to the sliding surface.

18. The axial piston machine as recited in claim 16, wherein the at least one opening includes a plurality of differently shaped openings.

19. The axial piston machine as recited in claim 16, wherein the sliding surface includes a pocket-shaped region formed in the sliding surface opposite a drive mechanism housing wall, the pocket shaped region providing a running surface, and being supplied via at least one opening.

* * * * *

UNITED STATES PATENT AND TRADEMARK OFFICE

CERTIFICATE OF CORRECTION

PATENT NO. : 7,500,425 B2 
APPLICATION NO. : 10/538719
DATED : March 10, 2009
INVENTOR(S) : Volker Seipel et al.

It is certified that error appears in the above-identified patent and that said Letters Patent is hereby corrected as shown below:

Delete Figure 5, insert Figure 5 shown below:

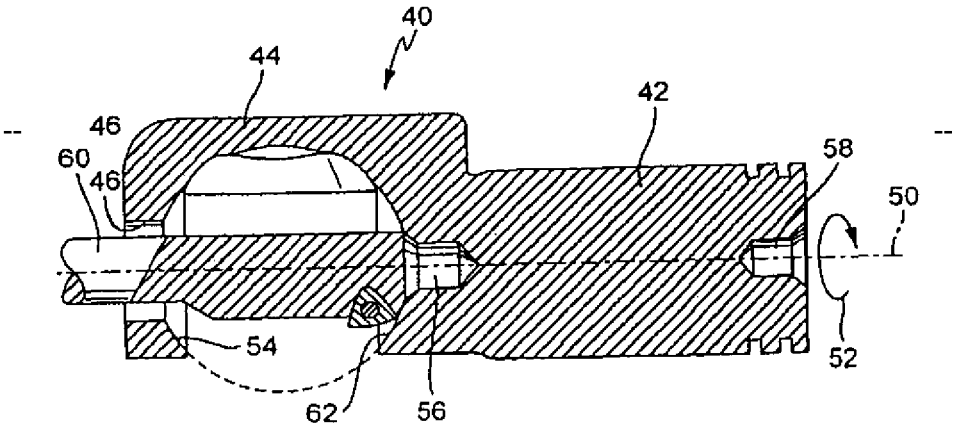

Signed and Sealed this

Twenty-sixth Day of May, 2009

John Doll

JOHN DOLL
*Acting Director of the United States Patent and Trademark Office*